United States Patent [19]

Knoble et al.

[11] Patent Number: 4,754,201

[45] Date of Patent: Jun. 28, 1988

[54] MAGNETIC LOW LOAD FACTOR SERIES BALLAST CIRCUIT

[75] Inventors: David W. Knoble; Joseph W. Sanders, both of Flat Rock, N.C.

[73] Assignee: General Electric Company, Schenectady, N.Y.

[21] Appl. No.: 19,094

[22] Filed: Feb. 26, 1987

[51] Int. Cl.[4] ..... H01J 1/60

[52] U.S. Cl. ..... 315/130; 315/189; 315/256; 315/220; 315/247

[58] Field of Search ..... 315/254, 255, 256, 130, 315/131, 189, 181, 220, 221, 222, 224, DIG. 7, 244; 361/35–38

[56] References Cited

U.S. PATENT DOCUMENTS

| | | | |
|---|---|---|---|
| 2,297,258 | 9/1942 | Spanner | 315/256 |
| 4,293,799 | 10/1981 | Roberts | 315/256 |
| 4,295,079 | 10/1981 | Otsuka et al. | 315/256 |
| 4,396,868 | 8/1983 | Watanabe et al. | 315/256 |

*Primary Examiner*—David K. Moore
*Assistant Examiner*—Michael Razavi
*Attorney, Agent, or Firm*—John P. McMahon; Philip L. Schlamp; Fred Jacob

[57] ABSTRACT

A series ballast circuit for operating a gas discharge tube from a constant current alternating voltage source having a fundamental frequency is disclosed. The primary feature of the ballast circuit comprises a ballast transformer having a magnetic core and at least a primary coil and at least a secondary coil. The ballast transformer has parameters that are selected in accordance with the operational conditions, that is, the extinguished and non-extinguished states of the gas discharge lamp. The primary coil and the area of the core have parameters selected in accordance with the extinguished state of the gas discharge tube. The primary and secondary coils have a selected turn ratio so as to produce a current level sufficient to maintain the ionization condition of the gas discharge tube in its non-extinguished state. The ballast circuit is operated in its heavy saturation condition during the extinguished state of the gas discharge so as to reduce the low factor, that is, the volt-ampere requirement of the ballast circuit itself. Reduction of the volt-ampere rating increases the number of ballast circuits that may be interconnected to the constant current alternating voltage source.

6 Claims, 4 Drawing Sheets

MAGNETIC LOW LOAD FACTOR SERIES BALLAST CIRCUIT

BACKGROUND OF THE INVENTION

This invention relates to a series ballast circuit for lamps having a ballast transformer for limiting the open circuit voltage and the voltage-ampere load of the lamp, and is particularly useful for series ballast circuits for sodium vapor lamps connected to a constant current series regulator loop.

Series ballast circuits have been and are still being used for various lighting applications such as street lighting and airport runway lighting. Series ballast circuits cause the same current to flow through all of the circuits of the lamps and are primarily used to regulate the power to the lamps. Although such circuits were originally used to operate incandescent lamps, many have been converted or are in the process of conversion to operate with gas discharge lamps most commonly of high pressure sodium (HPS) vapor lamps types. In a converted circuit, the voltage for initiating and maintaining the discharge of the HPS vapor lamp is derived from a ballast circuit typically connected to a constant current power source. In typical installations, the ballast circuits respectively related to the number of lamps involved are connected in a series loop across a secondary coil of a constant current regulator or power transformer.

In HPS vapor lamps a relatively high potential is necessary in order to initiate the arc or ionization condition for the lamp itself. This high potential is derived from the ballast transformer located at the input of the ballast circuit and is connected across the constant current power source. Because the secondary of the ballast transformer looks at or sees a very high impedance load until the arc condition is established in the lamp, the voltage across the primary and secondary of the ballast transformer is initially quite high. At this high voltage condition and in consideration of the constant current being supplied to the ballast transformer, the volt-ampere input required for each ballast circuit is therefore at a peak during the initial starting or extinguished condition of the lamp.

In such series ballasting arrangements connected to a constant current source, it is necessary to have only a certain maximum voltage dropped across the ballast circuits so as to be able to regulate the related current. This limitation is accomplished by limiting the number of ballast circuits that are interconnected to the constant current source. For a constant current source having a rating of 10 KW which is interconnected to ballast circuit for operating typical 200 W HPS vapor lamps having a volt-ampere requirement of 750 (VA), a limitation of (10 KW/750 VA) thirteen (13) ballast circuits is employed.

HPS vapor lamp ballast circuits which reduce the volt-ampere load seen by a constant current source and thereby increase the allowable ballast circuits interconnected to constant current sources are described in U.S. Pat. Nos. 4,339,695 and 4,441,056. Such HPS vapor lamp ballast circuits include a voltage limiting or clamping circuit arranged across a secondary of the ballast transformer that are operated in such a manner so as to reduce the volt-ampere requirement of the ballast circuits. The voltage limiting circuits employ electronic devices which when subjected to severe operating conditions, typically experienced during street lighting applications, encounter relatively large surge currents which commonly cause failures of such devices. It is desired that means more reliable than electronic devices which are susceptible to surge current failures be provided to reduce the volt-ampere requirement of the ballast circuits.

Accordingly, it is an object of the present invention to provide series ballast circuits having a non-electronic means to provide a high desired reliability, while at the same time reducing the volt-ampere requirement of the ballast circuit itself and allowing for an increase in the number of ballast circuits that may be interconnected to a constant current power source.

SUMMARY OF THE INVENTION

The present invention is directed to a magnetic device that reduces the volt-ampere requirement for series ballast circuits that are interconnected to a constant current alternating voltage source having a fundamental frequency.

The series ballast circuit comprises a transformer having a magnetic core and at least a primary coil and at least a secondary coil for respectively coupling the constant current alternating voltage source to a gas discharge lamp. The transformer has parameters selected in accordance with the operational conditions, that are, the extinguished and non-extinguished states of the gas discharge lamp. The parameters of the primary coil and the area of the magnetic core are selected so that when the transformer is energized and the gas discharge tube is in its extinguished state, the transformer develops at its secondary coil a high level of flux density occurring during the zero portion of the constant current alternating voltage source applied across the primary winding. The turns ratio between the primary and secondary coils is selected so that when the transformer is energized and the gas discharge tube is in its non-extinguished state, the transformer develops a level of current at the secondary coil sufficient to maintain the ionization condition of the gas discharge lamp. The series ballast circuit for a gas discharge lamp such as high pressure sodium lamp further comprises a starting means interconnected between the secondary coil and the high pressure sodium lamp for providing a high voltage starting pulse sufficient to initiate ionization of the gas discharge tube during any half cycle of the voltage source.

DETAILED DESCRIPTION OF THE PREFERRED EMBODIMENTS

Figure 1:
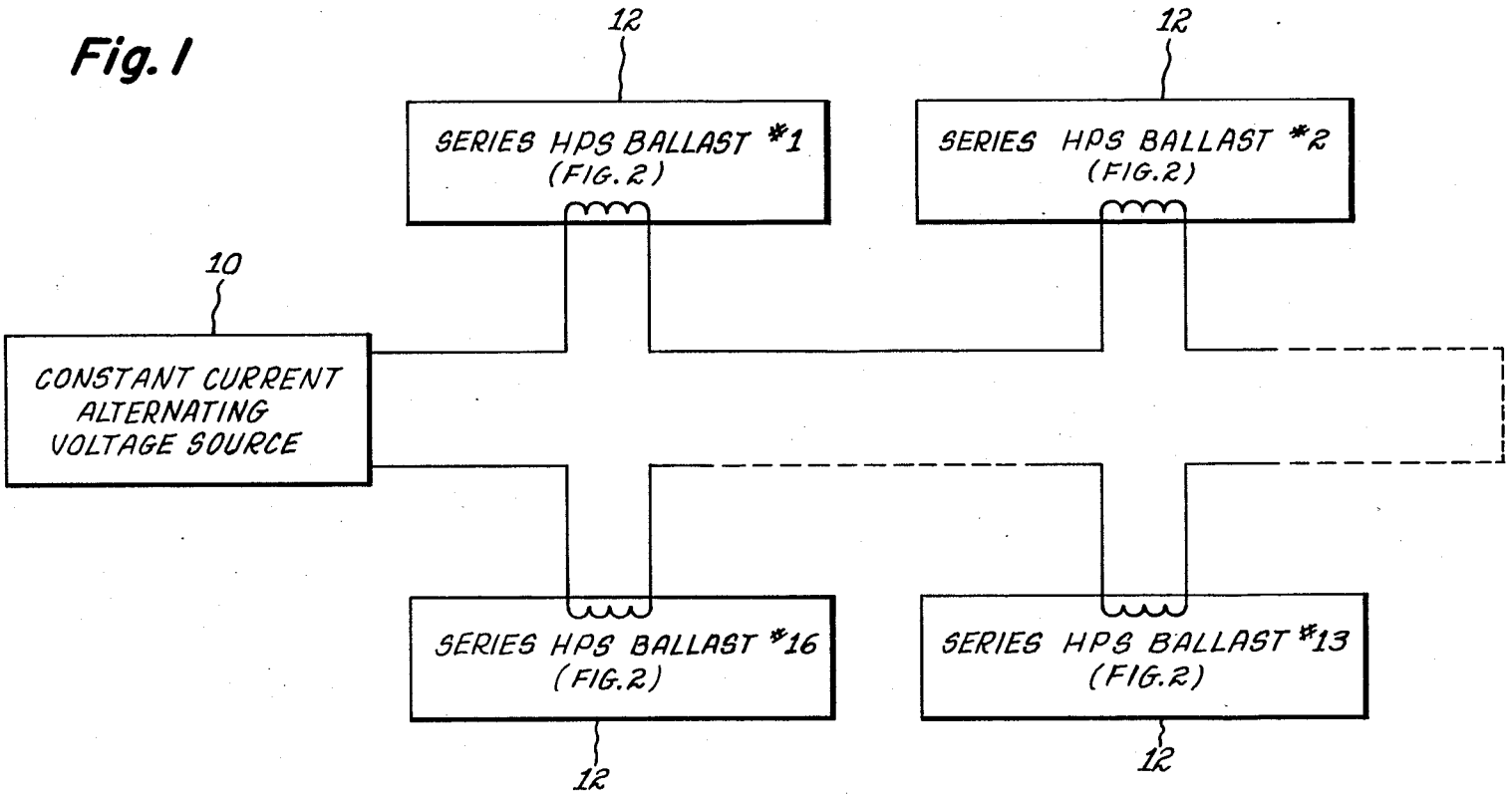
FIG. 1 is a schematic diagram showing a constant current source utilized for street lighting systems and arranged with a plurality of series ballast circuits.

Referring to FIG. 1, there is shown a constant current alternating voltage source 10 having a typical rating of 10 KW and which is employed for street lighting applications. The constant current source 10 is serially interconnected with and supplies essentially the same current to a plurality of ballast circuits 12 shown as 1–16. Contained within each of the ballast circuits 12 is a high intensity discharge lamp preferably high pressure sodium (HPS) vapor lamp (not shown in FIG. 1) having typical ratings of 70, 100, 150 and 200 watts.

For ballast applications for HPS vapor lamps, in order to initiate an ionization condition for this HPS vapor lamp, a relatively high voltage potential is necessary to be applied across the lamp itself. The high voltage potential is developed by each of the ballast circuits 12 for the respective HPS vapor lamp interconnected to the constant current source 10. The voltage and current conditions required to be supplied to a ballast circuits related to the HPS vapor lamps is specified in volt-ampere (VA) and for a typical 200 watts HPS lamp, not operated with the benefits of the present invention, is of a value of 750 VA. Considering the 10 KW rating of the constant current source 10 and the 750 VA requirement for each lamp, the number of ballast circuits 12, not having the benefits of the present invention, interconnected to the constant current source is limited to (10 KW/750 VA) thirteen (13). The present invention, as to be discussed in particular with regard to the ballast transformer of the ballast circuit, provides the means for reducing the 750 VA requirement for such a 200-watt HPS vapor lamp to a value of 617 VA so as to increase the number of ballast circuits 12 that are interconnected to the constant current source 10 from thirteen (13) to (10 KW/617 VA) sixteen (16).

Figure 2:
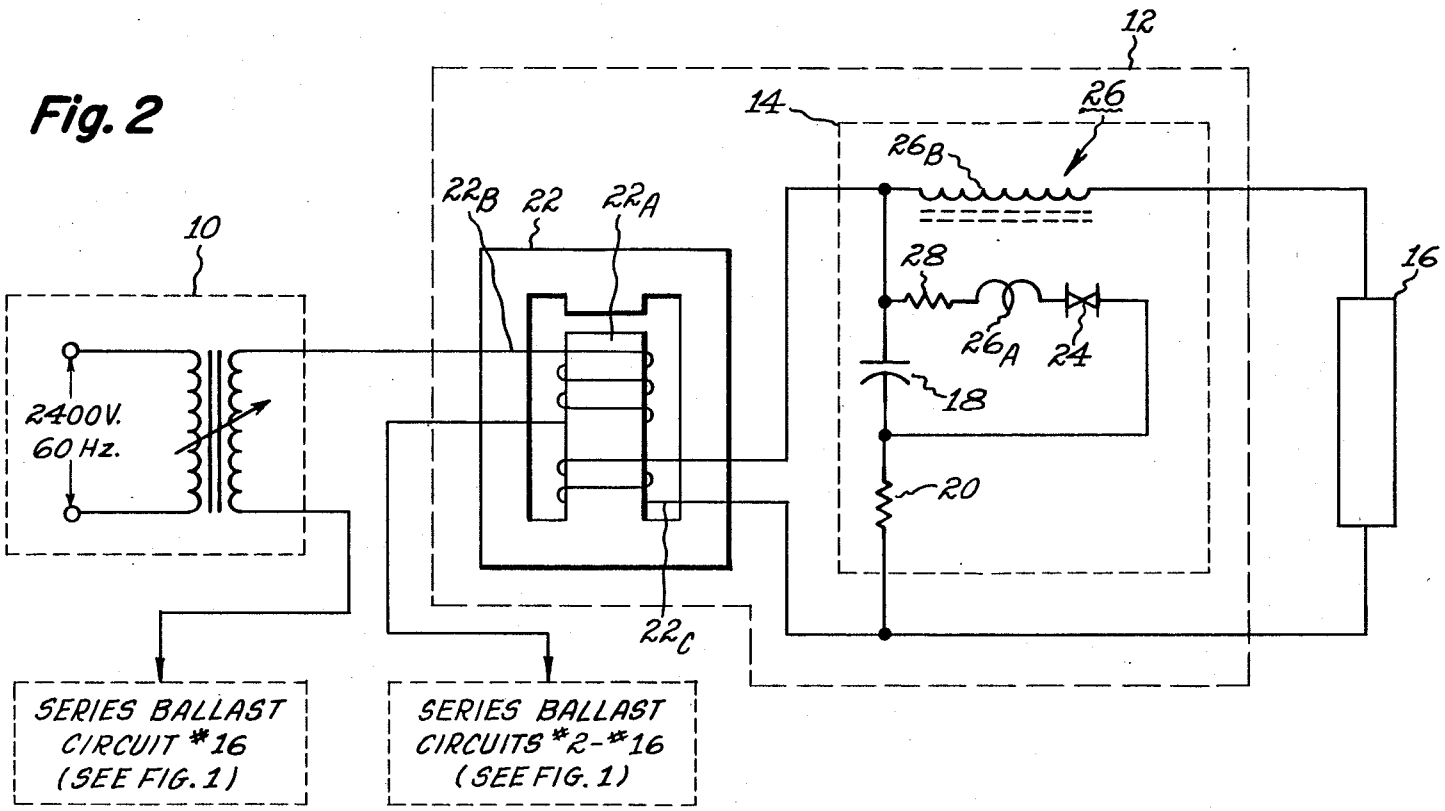
FIG. 2 is a schematic diagram of a series ballast circuit of the present invention arranged across the constant current regulator of FIG. 1.

The series ballast circuit of the present invention applicable to HPS vapor lamps is shown in FIG. 2 and includes a starting means such as a pulsing circuit 14 which provides a high voltage starting pulse sufficient to initiate the ionization condition of the HPS vapor lamp 16 during any half cycle of the constant current source 10. A pulsing circuit particularly suited for the present application is described in U.S. Pat. No. 4,527,098 of Daniel V. Owen assigned to the same assignee of the present invention and herein incorporated by reference.

The pulsing circuit 14 comprises a capacitor 18 which is connected in series with a charging resistor 20 across the secondary of the input ballast transformer 22. A voltage sensitive switch such as a SIDAC 24 is connected across the capacitor 18 and in series with the primary winding $26_A$ of a pulse transformer 26 and a resistor 28 having a relatively low value such as 4 to 7 ohms. The pulse transformer 26 has a core of magnetic material such as a ferrite material and possessing high frequency characteristics so as to accommodate the high frequency components of the starting pulse. The transformer 26 has a secondary winding $26_B$ which is connected in series with the lamp 16 across the secondary winding of the ballast transformer 22 which is located at the input stage of the ballast circuit 12.

In operation, the capacitor 18 charges through the resistor 20 on each half cycle of the constant current source 10 having a typical excitation of 2400 volts at a fundamental frequency of 60 Hz. The voltage derived by the ballast transformer 22 from the source 10 which is applied across the capacitor 18 and resistor 20 is about 200 volts at the fundamental frequency of 60 Hz. When the voltage across the capacitor 18 reaches a predetermined breakdown voltage of about 110 volts for the SIDAC 24, the voltage stored in the capacitor 18 is suddenly impressed across the primary winding of the pulse transformer 26 by way of the path supplied by resistor 28, the primary winding $26_A$ and a secondary winding $26_B$ of pulse transformer 26. Assuming a 20:1 primary to secondary turn ratio of transformer 26 and considering the breakdown voltage of SIDAC 24 of 110 volts, the voltage stored in capacitor 18 that is coupled through the pulse transformer 26 will result in a voltage pulse of almost 2200 volts which lasts for a fraction of a millisecond. The generation of this pulse on every half cycle of the applied 60 Hz excitation of source 10 continues until the lamp 16 obtains its initial ionization state. Thereafter, the lamp becomes a low impedance device to allow the current to be preferentially directed to the lamp 16 and essentially by-passing the charging of the capacitor 18 and the breakdown of the SIDAC 24 so that the pulsing circuit 14 remains quiescent.

The primary feature of the present invention is concerned with reducing the volt-ampere requirement of the series ballast circuit 12 by means of the ballast transformer 22 having a magnetic core $22_A$ and at least primary $22_B$ and secondary $22_C$ coils each with parameters selected in accordance with the operational, that is, the extinguished and non-extinguished states of the HPS vapor lamp 16. The ballast transformer 22 is selected so that the parameters of the primary coil and the area of the magnetic core are such that when the ballast transformer is energized and the gas discharge lamp is in extinguished (OFF) state, the ballast transformer 22 develops at its secondary coil a high level of flux density occurring during the zero portion of the constant current alternating voltage source applied across the primary winding. The ballast transformer is further selected so that the turns ratio between the primary and secondary coils is such that when the transformer is energized and the HPS vapor lamp is in its non extinguished (ON) state, the ballast transformer develops a current level such as 2.4 amperes at its secondary coil, sufficient to maintain the ionization condition of a typical HPS vapor lamp of a 200 watt rating.

The ballast transformer 24 operated from a 2400 volt, 10 KW alternating constant current voltage source having a fundamental frequency of 60 Hz has typical parameters which are given in Table 1.

TABLE 1

| | |
|---|---|
| Core Area | 1.86 $in^2$ |
| Core Material | Type M36 steel |
| Air Gap | 0.005 in |
| Primary Turns | 134 of 0.0605 inch diameter copper wire |
| Secondary Turns | 325 of 0.0403 inch diameter copper wire |
| Turns Ratio | 2.4 |

Figure 3:
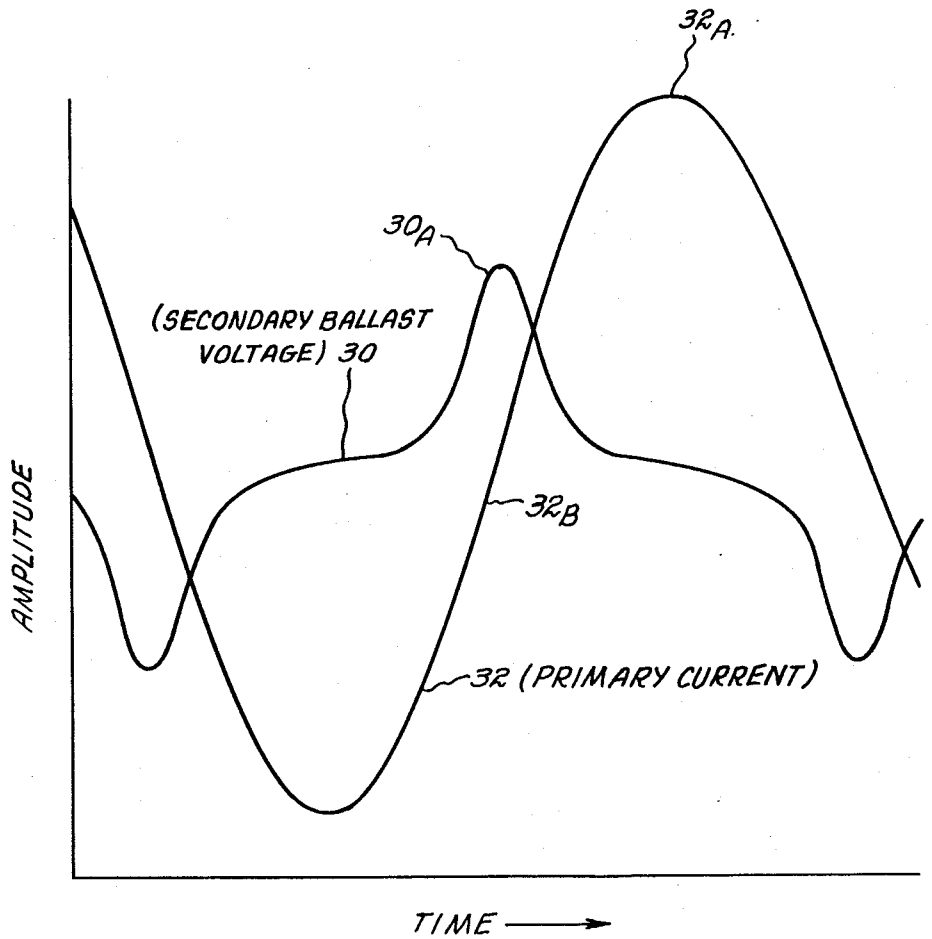
FIG. 3 shows the primary current related to the series ballast circuit along with the associated lamp voltage of the HPS lamp.

The operation of the present invention relative to the extinguished state of the HPS lamp may be described with reference to FIG. 3. FIG. 3 shows a heavily spiked secondary ballast voltage waveform 30 having peaked portions 30A which appears across the lamp 16 along with a substantially sinusoidal primary current waveform 32 appearing across the primary coil $22_B$ to the transformer 22.

When the lamp 16 is in its extinguished condition, the steel, in particular, the steel under the primary coil, is at a high level of flux density, exceeding a value of 120K lines/$in^2$. This high flux density is the cause of the generation of voltage harmonics to be described hereinafter. The flux density is alternating at fundamental frequency of the source 10 of current. At the point of highest current such as the peaked portion $32_A$ of the primary current 32, the flux density reaches a peak value exceeding 120K lines/in$^2$.

The shape of the voltage waveform 32 indicates that the flux density is at substantially this high value early in the voltage cycle. That is, the flux density is high for relatively low values of current 32, and continues to slowly increase as the current is proportional to the rate of change of flux. The flux changes rapidly when the current is quite small, and less rapidly when the current is higher. The peak of the voltage occurs near the current zero, since this is when the current, and consequently the flux, is changing most rapidly. From FIG. 3, it is seen that the peak portion $30_A$ of the secondary ballast voltage 30 occurs while the primary current 32 is at a zero condition shown as $32_B$.

The peaked secondary ballast voltage $30_A$ is realized, in that, when the ballast transformer 22 is driven into its heavy saturation condition causing a peak value of magnetic flux density in excess of 120K lines/in$^2$ when the lamp 16 is in its extinguished state, the transformer 22 creates, multiple signals of the odd harmonics (180 HZ, 300 HZ, etc.) of the fundamental frequency of the 60 Hz of the constant current source 10. Since the constant current power source 10 is strictly a sinusoidal source of 60 Hz, it does not supply power at any of these odd harmonics created signals. In particular, the 180 (300, etc.) Hz contribution to the peaked waveformed 30 which applied across the extinguished lamp, is not consummated from the power source 10, thus the 180 (300, etc.) Hz contribution voltage will not load down or draw current from the constant current source 10.

The present invention by heavily saturating the steel of the transformer produces, in combination with the 60 Hz contribution of the constant current source 10, the higher odd harmonics signals such as 180 Hz, 300 Hz, etc., which contribute to the open circuit voltage needed to initially ionize the extinguished HPS vapor lamps 16. The odd harmonics signals are not developed by the constant current source 10 and therefore do not cause loading of this constant current source 10.

The present invention by placing a magnetic ballast transformer into its heavily saturation condition avoids the need of prior art electronic devices of U.S. Pat. Nos. 4,339,695 and 4,441,056 discussed in the "Background" section. The circuit arrangements employing these prior art devices operate such that when the saturation state of their related ballast transformer is sensed, the solid state devices are activated to limit the peak voltage across the secondary of the ballast transformer. Conversely, the practice of the present invention places the ballast transformer 22 into saturation and continues this saturation condition so as to create the multiple harmonic of the 60 Hz frequency of the current source 10 which reduces the volt-ampere rating of the ballast circuits of the present invention. The utilization of 60 Hz component of the current source 10 related to present invention is about 83% compared to essentially 100% utilization of prior art devices not having the current limiting benefits of the prior art device of U.S. Pat. No. 4,339,695 nor the benefits of the present invention. This factor of 17% reduces the volt-ampere of 750 VA for a typical 200 watt HPS vapor in its extinguished state which is operated from a non-saturated ballast transformer, to a volt-ampere of 617 VA yielded by the operation of the heavily saturated ballast transformer 22 of the present invention. In consideration of this factor of 17%, the number of series ballast circuits that may be interconnected to the typical 10 KW constant current source 10 when the HPS vapor lamps of concern are in their extinguished state, is increased from thirteen (10 KW/750 VA) to sixteen (10 KW/617 VA).

Figure 4:
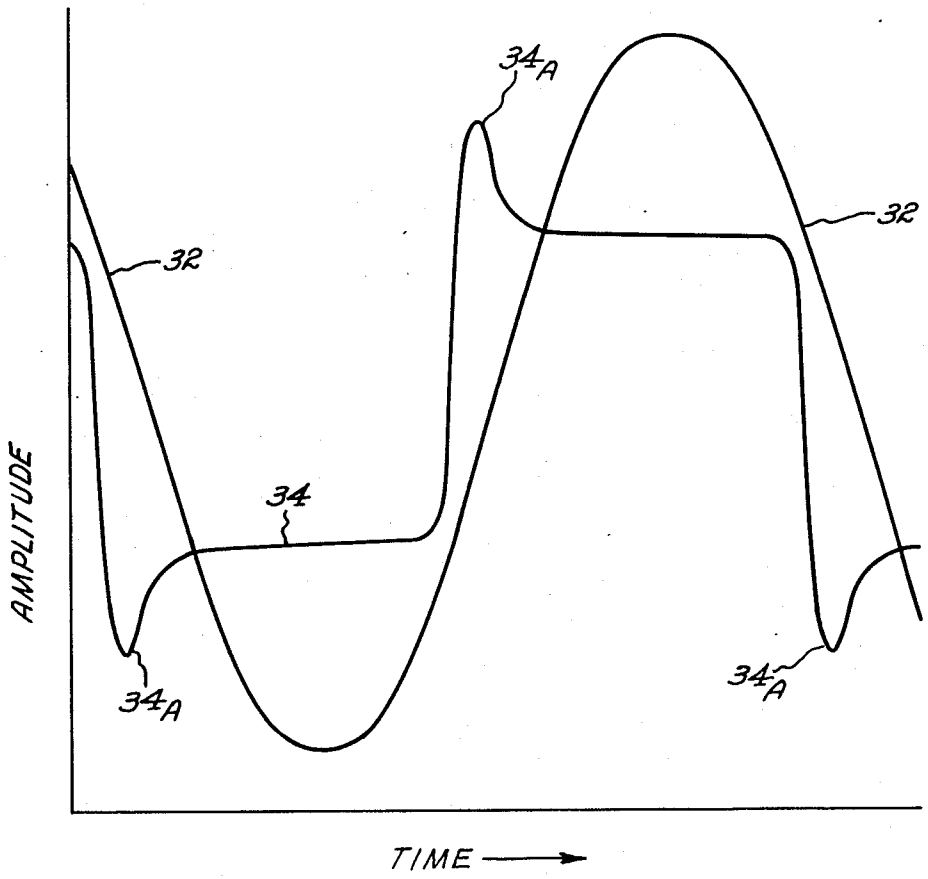
FIG. 4 shows the primary current of the series ballast circuit along with the secondary voltage of the ballast circuit.

The non-extinguished or ON operating condition of the HPS vapor lamp may be described with reference to FIG. 4. FIG. 4 shows the previously discussed substantially sinusoidal primary current 32 along with a voltage waveform 34 of the lamp 16 having peaked portions $34_A$ corresponding to the reignition state of the lamp 16.

Although the present invention describes a ballast transformer 22 having an inner air gap which allows control of the primary inductance presented to a power source, it has been determined that because the ballast transformer 22 is primarily operated at a saturation condition, the need for such an air gap is eliminated. The elimination of such an air gap yields a transformer having a reduced cost of manufacturing since there is no need for an air gap which requires a banding operation for its related laminations. This elimination allows for the laminations of the ballast transformer 22 to be welded. The reduced cost is realized in that the banding operation is more labor intense than the welding operation.

Although the previously given description of the ballast circuit 12 included a starting aid such as pulse circuit 14, it should be recognized that such a starting aid is utilized when the gas discharge lamps is of the high pressure sodium vapor type requiring a starting pulse. For other gas discharge lamps not requiring such a starting pulse, the ballast transformer by itself provides the desired operating conditions for such discharge lamps.

It should now be appreciated that the practice of present invention provide a series ballast circuit for a gas discharge lamp, preferably of a HPS vapor type, having a magnetic ballast transformer. The ballast transformer is operated in a heavily saturated condition when the HPS lamp is in its extinguished state. Such saturation operation reduces the load factor, that is the volt-ampere rating of the ballast circuit, so as to allow more ballast circuits to be interconnected with a constant current source.

What we claim as new and desire to secure by Letters Patent of the United States is:

1. A ballast circuit capable of operating a gas discharge lamp from a constant current alternating voltage source having a fundamental frequency comprisiing:

a ballast transformer having a magnetic core and at least a primary coil and at least a secondary coil for respectively coupling the constant current source to the gas discharge lamp, said ballast transformer having parameters selected in accordance with the operational conditions, that are, the extinguished and non-extinguished states of the gas discharge lamp, said primary coil and the area of said magnetic core having selected parameters so that when said ballast transformer is energized and said gas discharge lamp is in its extinguished state, said transformer developes across its secondary coil a relatively high level of flux density occurring during the zero portion of the constant current alternating voltage source applied across the primary winding to intiate an ionization condition of said extinguished lamp, said primary and secondary coils having a respective turn ratio so as to provide a current level of a sufficient value so to maintain an ionization condition of said gas discharge tube when it is in its non-extinguished state.

2. A ballast circuit capable of operating a high pressure sodium vapor lamp from a constant current alternating voltage source having a fundamental frequency comprising;

a ballast transformer having a magnetic core and at least a primary coil and at least a secondary coil for respectively coupling the constant current source to the gas discharge lamp, said ballast transformer having parameters selected in accordance with the operational conditions, that are, the extinguished and non-extinguished states of the gas discharge lamp, said primary coil and the area of said magnetic core having selected parameters so that when said ballast transformer is energized and said gas discharge lamp is in its extinguished state, said transformer develops across its secondary coil relatively high level of flux density occurring during the zero portion of the constant current alternating voltage source applied across the primary winding, said primary and secondary coils having a respective turn ratio so as to provide a current level of a sufficient value so to maintain an ionization condition of said gas discharge tube when it is in its non-extinguished state; and starter means interconnected between said secondary coil and said gas discharge lamp for providing a high voltage starting pulse sufficient to initiate an ionization condition of said gas discharge lamp during any half cycle of said voltage source.

3. A method for operating a gas discharge lamp from a constant current alternating voltage source having a fundamental frequency comprising:

providing a ballast transformer capable of being coupled between said constant current source and said gas discharge tube, said ballast transformer having a magnetic core and at least a primary and at least a secondary coil each with parameters selected in accordance with the operational condition, that is, the extinguished and non-extinguished states of the gas discharge tube;

selecting the parameters of the primary coil and the area of said magnetic core so that when said ballast transformer is energized and said gas discharge lamp is in its extinguished state, said transformer develops a relatively high level of flux density occurring during the zero portion of the contant current alternating voltage source applied across the primary winding to initiate an ionization condition of said extinguished lamp; and selecting the turns ratio between the primary and secondary coils so that when said ballast transformer is energized and said gas discharge lamp is in its non-extinguished state, said transformer develops a current level at its secondary coil of a sufficient value so as to maintain the ionization condition of said discharge lamp in its non-extinguished state.

4. A method for operating a high pressure sodium vapor lamp from a constant current alternating voltage source having a fundamental frequency comprising:

providing a ballast transformer having a magnetic core and at least a primary coil and at least a secondary coil each with parameters selected in accordance with the operational conditions, that are, the extinguished and non-extinguished states of the gas discharge tube;

selecting the parameters of the primary coil and the area of said magnetic core so that when said ballast transformer is energized and said gas discharge lamp is in its extinguished state, said transformer develops a relatively high level of flux density occurring during the zero portion of the constant current alternating voltage source applied across the primary winding;

selecting the turns ratio between the primary and secondary coils so that when said ballast transformer is energized and said gas discharge lamp is in its non-extinguished state, said transformer develops a current level at its secondary coil of a sufficient value so as to maintain the ionization condition of said discharge lamp in its non-extinguished state;

connecting a starter means between said secondary coil and said gas discharge lamp, said starting means be selected so as to provide a high voltage starting pulse sufficient to initiate ionization of said high pressure sodium vapor lamp during any half-cylce of said voltage source; and applying said current source across said primary coil.

5. A ballast circuit in accordance with claim 1 wherein said constant current source is of a 2400 volt 60 Hz type, said level of flux density is in excess of 120K lines/in$^2$, and said ballast transformer comprises;

(a) Core Area of 1.86 in$^2$;
(b) Core Material of steel;
(c) 134 Primary Turns of 0.0605 inch diameter copper wire;
(d) 325 Secondary Turns of 0.0403 inch diameter copper wire; and
(e) Turns Ratio of 2.4.

6. A ballast circuit in accordance with claim 2 wherein said constant current source is of a 2400 volt 60 Hz type said level of flux density is in excess of 120K lines/in$^2$, and said ballast transformer comprises;

(a) Core Area of 1.86 in$^2$;
(b) Core Material of steel;
(c) 134 Primary Turns of 0.0605 inch diameter copper wire;
(d) 325 Secondary Turns of 0.0403 inch diameter copper wire and;
(e) Turns Ratio of 2.4.

* * * * *